US005192842A

United States Patent [19]

Kim

[11] Patent Number: 5,192,842

[45] Date of Patent: Mar. 9, 1993

[54] MICROWAVE OVEN HAVING ROTATABLE TRAY WHICH MOVES UP AND DOWN DURING ROTATION

[75] Inventor: Yung H. Kim, Suweon, Rep. of Korea

[73] Assignee: Samsung Electronics Co., Ltd., Kyungki, Rep. of Korea

[21] Appl. No.: 701,065

[22] Filed: May 16, 1991

[30] Foreign Application Priority Data

May 16, 1990 [KR] Rep. of Korea ..... 90-6549[U]
May 16, 1990 [KR] Rep. of Korea ..... 90-7010[U]

[51] Int. Cl.[5] ..... H05B 6/78

[52] U.S. Cl. ..... 219/10.55 F; 219/10.55 E; 108/20; 99/443 R; 126/338

[58] Field of Search ..... 219/10.55 F, 10.55 E; 108/20, 141; 99/DIG. 14, 443 R; 126/338

[56] References Cited

U.S. PATENT DOCUMENTS

| | | | |
|---|---|---|---|
| 3,436,506 | 4/1969 | Smith | 219/10.55 F |
| 4,631,379 | 12/1986 | Aoyama | 219/10.55 F |
| 4,652,712 | 3/1987 | Zeipel | 219/10.55 F |
| 4,725,703 | 2/1988 | Park | 219/10.55 F |
| 4,742,202 | 5/1988 | Campbell et al. | 219/10.55 F |
| 4,757,173 | 7/1988 | Park | 219/10.55 F |

FOREIGN PATENT DOCUMENTS

| | | |
|---|---|---|
| 60-118894 | 8/1985 | Japan . |
| 61-19999 | 2/1986 | Japan . |

*Primary Examiner*—Philip H. Leung
*Attorney, Agent, or Firm*—Burns, Doane, Swecker & Mathis

[57] ABSTRACT

A microwave oven has a tray in its cooking chamber, the tray having an upwardly facing surface for supporting food. A driving mechanism rotates the tray about an upright axis while displacing the tray up and down. The tray may be disposed horizontally or at an angle to horizontal, as it rotates.

10 Claims, 6 Drawing Sheets

MICROWAVE OVEN HAVING ROTATABLE TRAY WHICH MOVES UP AND DOWN DURING ROTATION

BACKGROUND OF THE INVENTION

1. Field of the Invention

The invention relates to a microwave oven for cooking foodstuffs, and more particularly to a microwave oven provided with a rotatable tray on which foodstuffs are mounted.

2. Description of Prior Art

In a conventional microwave oven, such as an electronic oven range, articles on a cooking tray inside the cooking chamber of an oven are heated by microwaves, which are radiated directly from a microwave generator, such as a magnetron, and/or radiated indirectly inside the cooking chamber with a relatively larger amount of microwaves.

Also, some of conventional microwave ovens have been provided with a rotatable tray in order to get articles thereon to be heated equally by directly and indirectly radiating microwaves.

Japanese Utility Model Laid-Open Publication No. Sho. 61-19999, published on Feb. 5, 1986 has disclosed a representative example of a conventional electronic oven range including a rotatable tray. The oven range disclosed in the above Japanese application comprises a rotatable tray, a driving motor having a driving shaft driving the rotatable tray, a rotatable driven arm assembly mounted detachably to the driving shaft of a motor in the base under the rotatable tray. A plurality of rotatable support rollers are respectively mounted to some of the arms at a predetermined interval, and a guide groove is formed under the rotatable tray for receiving the support rollers therein thereby to force the rollers to move frictionally and slidably thereon. Also provided are sub-rollers of the same quantity as the support rollers, in which each of sub-rollers has a diameter smaller than that of the support roller. The sub-rollers are mounted detachably to the remaining rotatable driven arms so that each sub-roller is positioned between two of the support rollers.

Also, there has been another example of the conventional electronic oven range, as disclosed in Japanese Utility Model Laid-Open Publication No. Sho. 60-118894, published on Aug. 10, 1985. This Japanese application has disclosed an electronic oven range comprising a rotatable tray, a plurality of support rollers mounted under the rotatable tray in order to support the tray while slidably moving around the rotating center of the rotatable tray. A roller support for the support rollers induces the rollers to move the rotatable tray in radial direction. A microwave reflector moves along with the rollers at radial directions, and a roller path is provided for guiding the movement of the rollers, the path being non-concentric to the rotation center of the rotatable tray.

However, in a conventional microwave oven, such as the electronic oven range disclosed in the Japanese applications, the tray has been provided with a horizontal flat surface and simply positioned on the rotation member of the oven. Therefore, during operation, the incidence angles of microwaves radiating toward articles on the rotatable tray are always fixed. Thus, the microwave radiation to the articles could not be uniformly dispersed, thereby causing the cooking performance of an electronic oven range to be deteriorated.

Accordingly, if microwaves radiate at various incidence angles to the surface of articles on a rotatable tray, a microwave oven, such as a cooking oven, can remarkably enhance the reliability of products.

Also, it is noted that the variation of the incidence angles can accomplish the uniform radiation of microwaves to articles to be cooked.

Thus, it is an object of the invention to provide a microwave oven for performing the operation of a rotation member in various methods to induce the uniform radiation of microwaves to articles to be cooked.

It is other object of the invention to provide a microwave oven capable of varying incidence angles of microwaves radiating to articles on a rotatably tray.

It is another object of the present invention to provide a microwave oven capable of rotating a rotation member following its up/down movement according to the rising and lowering of the rotation member.

It is still another object of the invention to provide a microwave oven including a rotation member, a plurality of arms which are partly raised in a paired form when other arms are lowered in a paired form, or vice versa.

In accordance with the invention, the above and other objects can be accomplished by providing three embodiments embodying a microwave oven according to the invention.

SUMMARY OF THE PREFERRED EMBODIMENTS OF THE INVENTION

The first embodiment comprises a rotation member including at least one of a relatively longer support arms and at least one pairs of a relatively shorter support arms, which are moulded into one body, and at least one pair of rollers having a relatively larger diameter mounted on the shorter arms. At least one pair of rollers having a relatively smaller diameter, are mounted on the longer arms. A tray is placed simply on the rotation member by seating it on the rollers. During the operation of the rotation member, the tray rotates at an inclined state because of the rotation of the rollers having the different sizes in a paired form, so that the dissipation of microwaves can be accomplished at various incidence angles to the tray.

The second embodiment comprises a rotation member, which is provided with a plurality of arms and a plurality of rollers fixed rotatably to the arms, respectively, and cams positioned on the bottom of the cooking chamber at given intervals, which are provided with a inclined portion and a convex portion. Thus, when the rollers of the rotation member, on which a tray is placed, move along the cams, they rotate the tray so that the cams produce up and down motions of the tray, so that the dissipation of microwaves may be occurred at various incidence angles to articles to be cooked.

The third embodiment is provided with a rotation member including three rotation arms and rollers of the same diameter fixed rotatably to each free end of the arms. Of which arms, two arms have a relatively longer length and the other arm has a relatively shorter length. Also, the bottom of the cooking chamber is provided with outer and inner cams of certain height, each of which includes an inclined surface and a convex portion. The cams are arranged along the outer and inner circumferential paths of the arms in a pair 3, so that the rollers of the relatively longer arms may be raised over the outer cams, or otherwise the roller of the relatively shorter arm be raised over the inner cams, thereby forcing the tray to be rotated while inclined.

BRIEF DESCRIPTION OF THE DRAWINGS

The above and other objects, features and advantages of the present invention will be more clearly understood from the following detailed description taken in conjunction with the accompanying drawings, in which.

BRIEF DESCRIPTION OF THE PREFERRED EMBODIMENTS

Figure 1:
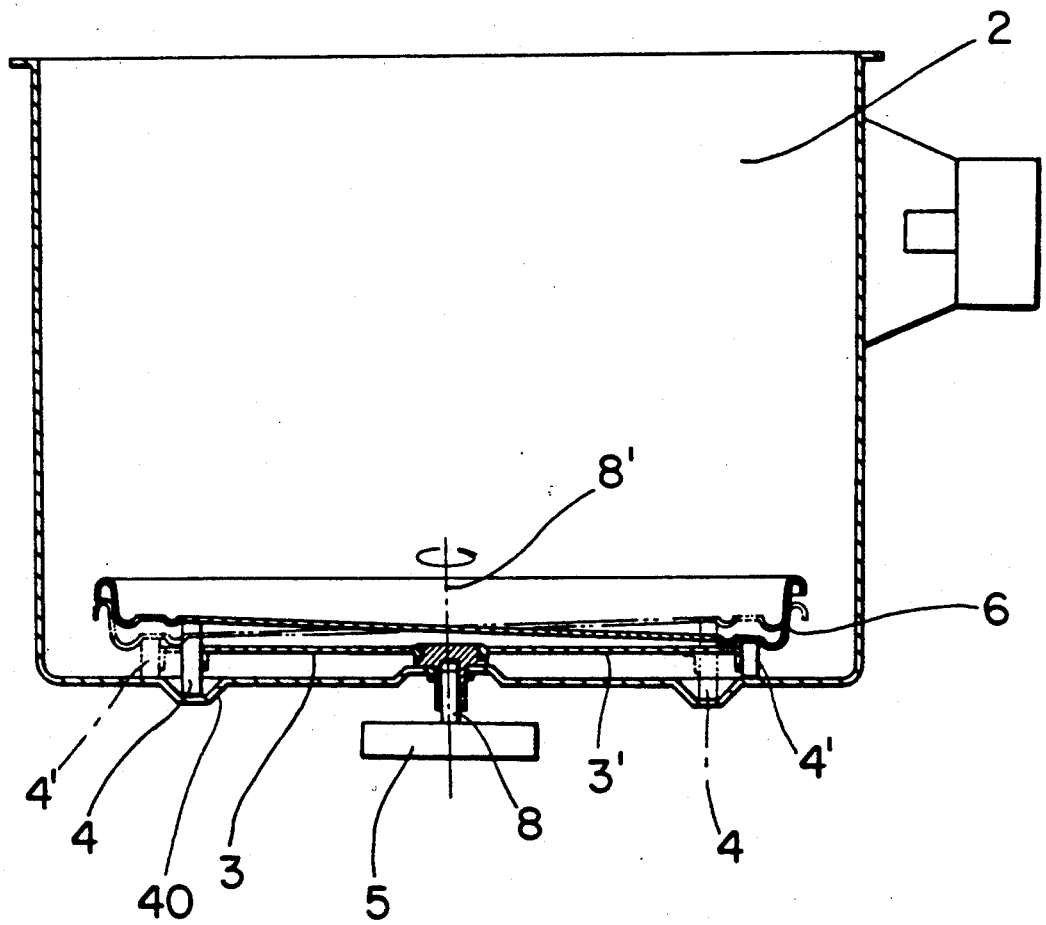
FIG. 1 is a schematic vertical section view of a first embodiment embodying a microwave oven in accordance with the invention.
Figure 2:
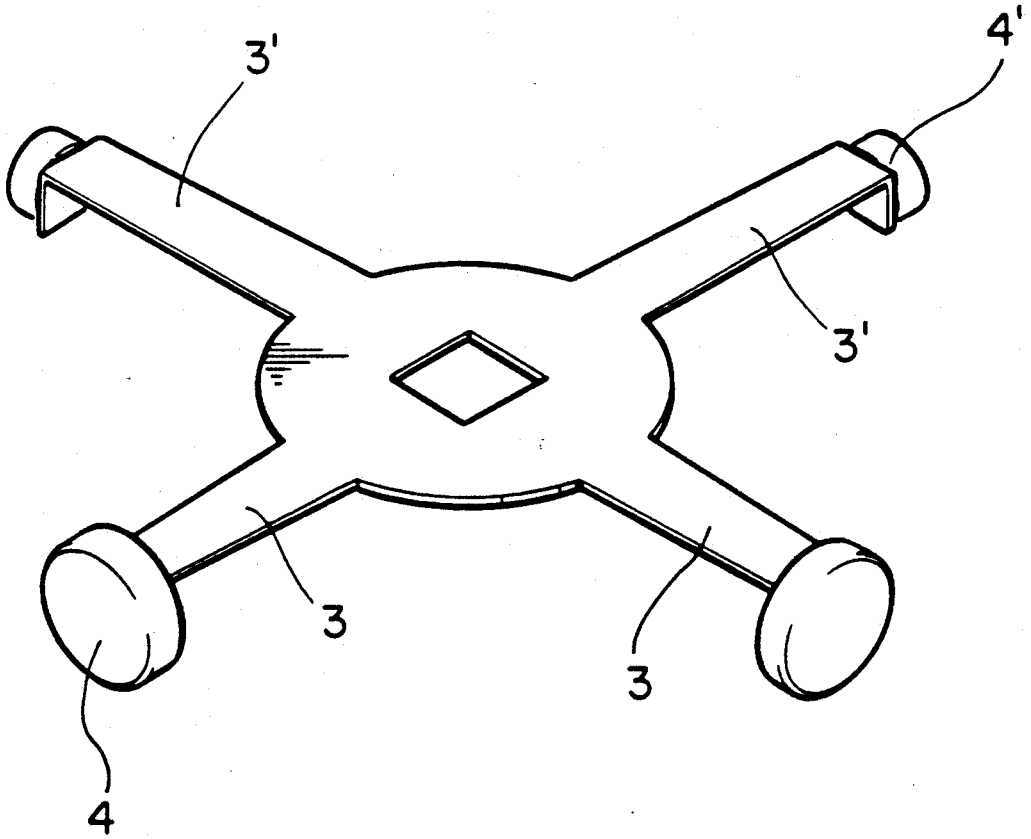
FIG. 2 is a perspective view of a rotation member of the microwave oven of FIG. 1.

Turning now to FIGS. 1 and 2 the first embodiment of the microwave oven comprises a cooking chamber 2, a driving device 5, a driving shaft 8 of the driving device 5, a rotation member mounted rotatably to the driving shaft 8, and a tray 6 simply laid on the rotation member.

As shown in FIG. 2, the rotation member comprises a pair of relatively long support arm 3' and a pair of relatively short support arms 3. Support elements are provided in the form of a pair of rollers 4 having a relatively large diameter rotatably mounted to the ends of the shorter arms 3, and a pair of rollers 4' having a relatively small diameter coupled rotatably to the ends of the longer arms 3'. Also, the first embodiment of the microwave oven is provided with a roller guide groove 40 formed to have a predetermined circumference around a vertical axis 8' of the driving shaft 8 on the bottom of the cooking chamber 2. It is adapted for guiding the rolling movement of the relatively larger diameter rollers 4. In FIG. 1, even though a path 40 for the rollers 4 is shown as a concaved groove, the path may be formed as a convexed portion or a track, for example a rail.

The tray 6 is simply laid on the rotation member, contacting with the rollers 4 and 4', thereby rotating along with the rotation member by frictional forces generated between the lower surface thereof and the rollers 4 and 4'. The large diameter rollers 4 are disposed together on one side of the axis 8, and the small diameter rollers 4' are disposed together on the opposite side of the axis, as shown in FIG. 2. Thus, a tray 6 laid upon the four rollers 4, 4' will be inclined to horizontal, i.e., non-perpendicular to the axis 8. That is, the portion of the tray contacting the larger diameter rollers 4 will be a higher elevation than the portion contacting the small diameter rollers 41', as shown in FIG. 1. Therefore, during the operation of the rotation member cooperating with the driving device 5, the tray 6 rotated on the rollers 4 and 4' must be variable as representing in solid lines or dotted lines in FIG. 1, in that the height difference between the rollers on the bottom plane is continuously changed following the rotation inclined angles of the tray 6, thereby performing the uniform dissipation of microwaves at various incidence angles. In other words, as the result of normal slippage between the rollers 4, 4 and the tray, there will occur relative rotation between the driving member 3, 3' and the tray 6.

Figure 3:
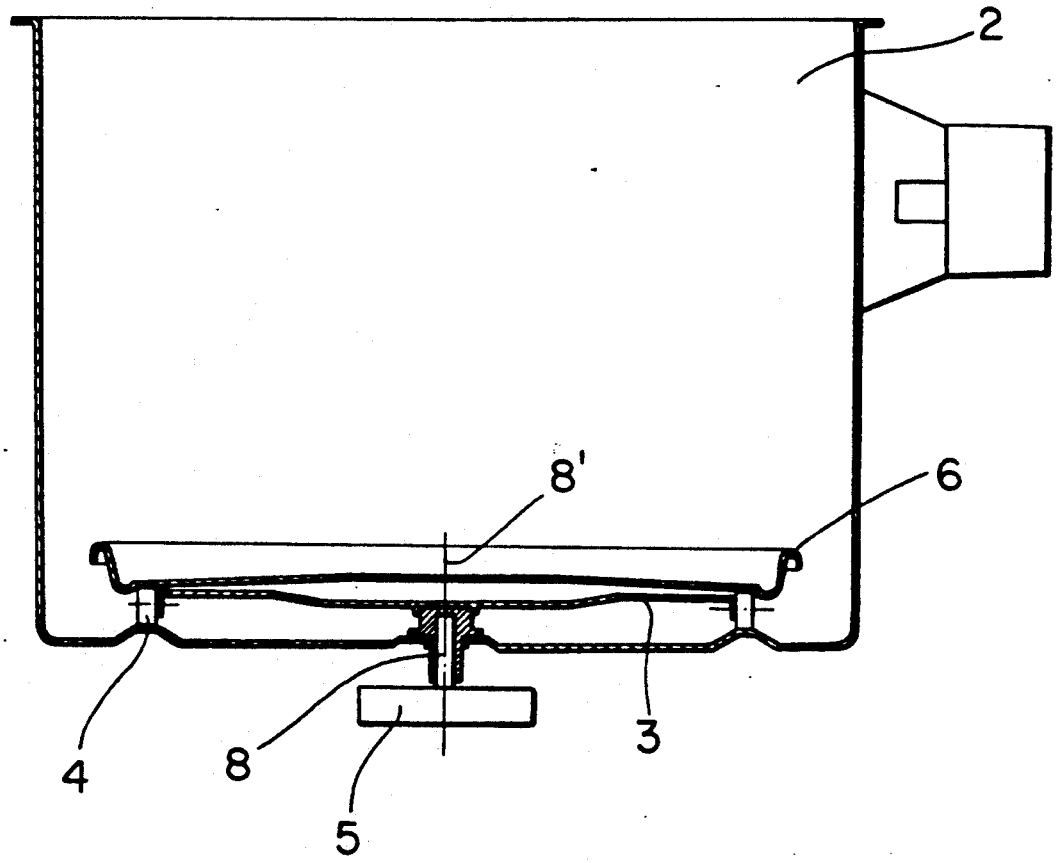
FIG. 3 is a schematic vertical section view of a second embodiment embodying a microwave oven in accordance with the invention.
Figure 4:
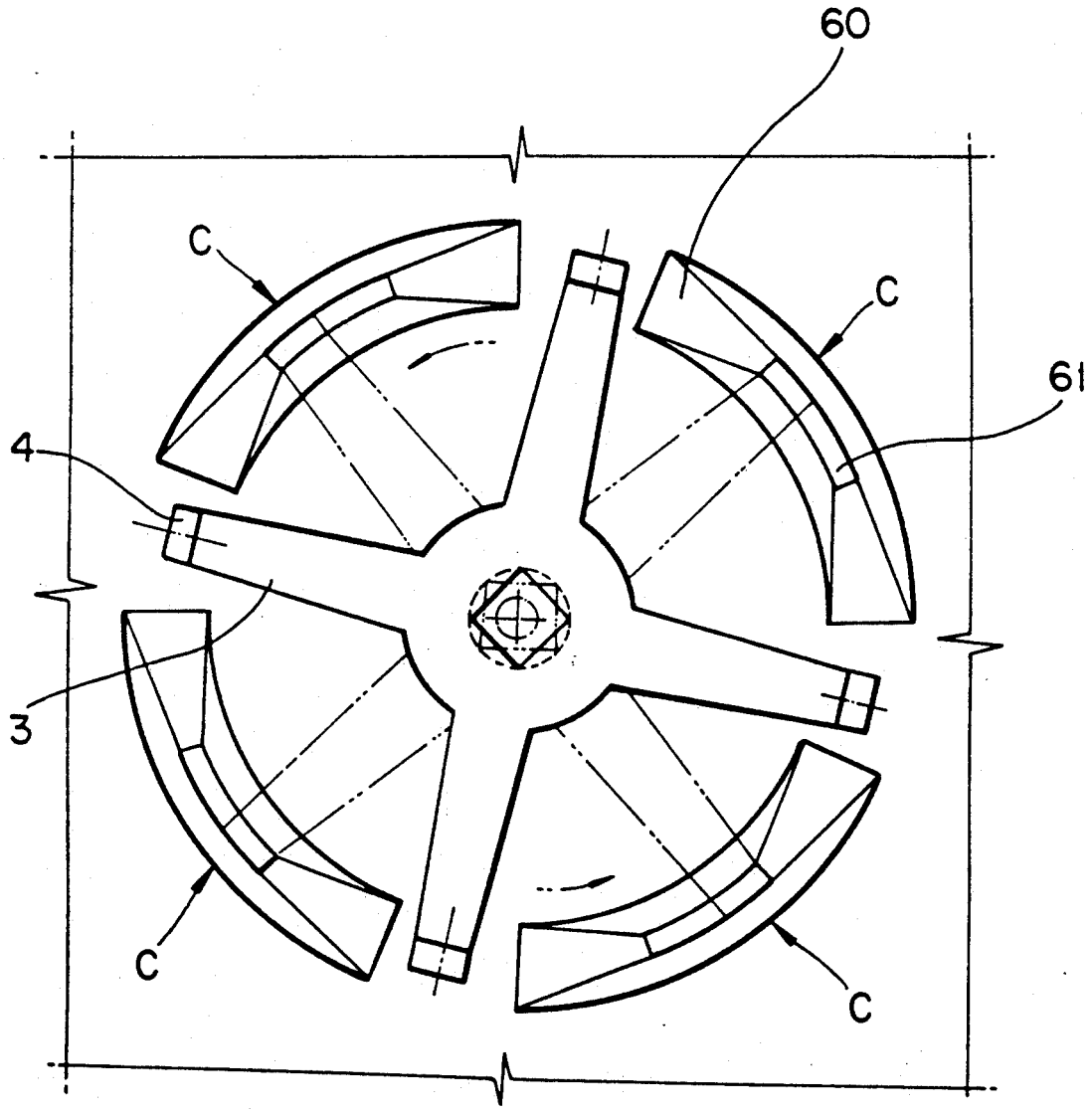
FIG. 4 is a schematic plan view showing a track and a rotation member of the microwave oven of FIG. 3.

In FIGS. 3 and 4 showing the second embodiment, elements having the same functions as those of the first embodiment are designated by the same numerals.

In the second embodiment of the microwave oven, all the rotating arms 3 have the same length and all the rotation rollers 4 also have the same size.

As shown in FIG. 4, the rotating rollers 4 are mounted rotatably to the free ends of arms 3. Each arm 3 is extended symmetrically from the driving shaft 8. Also, the driving shaft 8 is mounted with an expansion/-contraction device, such as a spring, to a driving device 5, thereby permitting the rotating shaft of the rotation member to move upward and downward corresponding to the change of the vertical height of the rotation member moving along cam C as described below.

On the other hand, each of the cams includes a inclined portion 60 and a convex portion 61, but it may be formed as a concaved portion having a inclined portion.

When the rotation member is rotated by a driving shaft, it can be also operated upward and downward along the cams while remaining horizontal as viewed in FIG. 3. Alternatively, if the facing cams arranged symmetrically to the driving shaft 8 are respectively made convex and concave, the rotation member can rotate, moving slantly along the inclined portion and convex portions or the concave portion of the cams.

Figure 5:
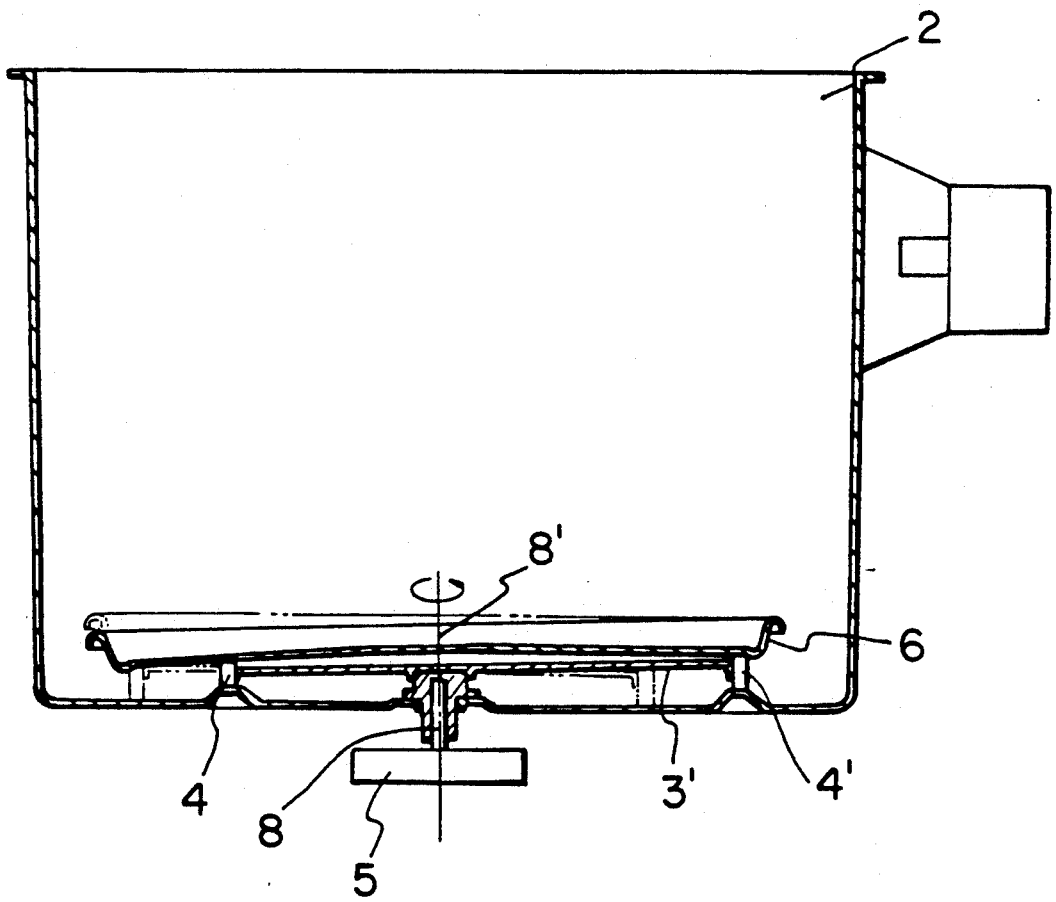
FIG. 5 is a schematic vertical sectional view of a third embodiment embodying a microwave oven in accordance with the invention.
Figure 6:
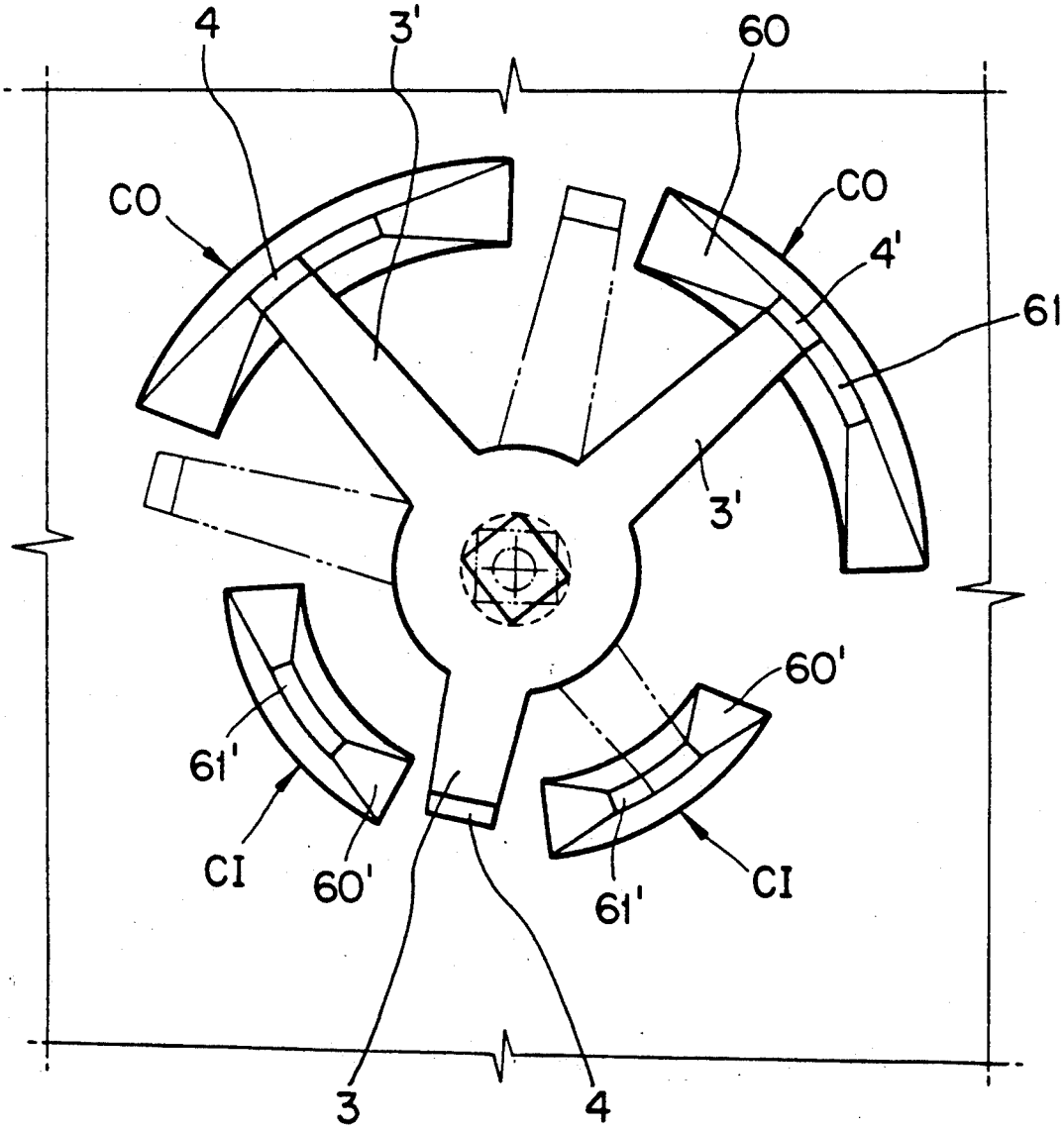
FIG. 6 is a schematic plan view showing track and a rotation member of the microwave oven of FIG. 5.

FIG. 5 shows the third embodiment of the invention and FIG. 6 is a plan view of a rotatable roller 4 and a track on the bottom of a cooking chamber. In the microwave oven of this embodiment, the rotating member comprises several rotation arms 3 and 3' being rotated by a driving device 5 and several rollers 4 and 4' of the same diameter are fixed rotatably at each of the free ends of the arms. A tray 6 is simply placed on the rollers 4 and 4'. The rotation arms 3 and 3' have different length from each other. As shown in the drawings, the arms 3 are longer than the other arm 3'. The arms 3 are approximately arranged at a right angle to each other around a driving shaft 8, but 3' and arms are arranged to form about 135° angles therebetween around the driving shaft 8.

On the other hand, the bottom of the cooking chamber is provided with outer and inner cams CO and CI of a certain height, each of which includes an inclined surface, 60' and a convex portion 61', as represented in the second embodiment above-mentioned. The cams are arranged along the circumferential paths of the arms 3 and 3', respectively. The rollers 4' move along the outer circumferential path which corresponds to the length of the arms 3. The roller 4 moves along the inner circumferential path which corresponds to the length of the arm 3. In this embodiment, each of the outer cams CO faces one of the inner cams CI.

Accordingly, while the rotating member rotates about the center shaft, the rollers 4' of the arms 3' are at the bottom floor of the cooking chamber, while the roller 4 is on a cam portion 61' (as shown in broken lines in FIG. 6), and thus the tray 6 is rotated at an inclined state. Also, the roller 4 of the rotation arm 3' moves along the inner cams CI, the rollers 4' of the rotation arms 3' are placed at the bottom floor of the cooking chamber as shown in said lines. Furthermore, as the rollers 4 and 4' move along the inclined portion, they force the rotation member to be moved, slantly.

In this embodiment, the concave portion may be substituted for the convex portion of the cams like the second embodiment.

In a microwave oven for heating articles placed on a tray during the operation of a rotation member, the microwave oven according to the invention can make a rotation member provide the continuous changing of incidence angles of microwaves to the articles unlike the conventional structure moving a tray in a horizontal plane. Therefore, the radiation of microwaves to articles on the tray can be uniformly induced.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. In a microwave oven comprising a cooking chamber having a floor; microwave generating means for supplying microwaves to said cooking chamber; and a tray disposed within said cooking chamber carrying food to be cooked; the improvement comprising:

a rotation member including a body mounted at its center in said cooking chamber for rotation about an upright axis, and a plurality of rollers freely rotatably mounted to said body and arranged to ride upon said floor;

said tray being seated upon said rotation member; and drive means for rotating said rotation member and said tray about said upright axis;

a radial spacing of at least one of said rollers from said upright axis being different than that of at least one other of said rollers, and said one roller having a larger diameter than said other roller, whereby said tray is inclined relative to horizontal during rotation.

2. Apparatus according to claim 1, wherein said roller of large diameter continuously engages a portion of said floor which is of lower elevation than a portion of said floor engaged by said roller of smaller diameter, in order to maintain said body of said rotation member horizontal during rotation.

3. Apparatus according to claim 2, wherein said floor portion of lower elevation comprises a circular groove.

4. Apparatus according to claim 2, wherein said tray is seated directly upon said rollers.

5. Apparatus according to claim 4, wherein said roller of smaller diameter is spaced radially farther from said upright axis than said roller of larger diameter.

6. Apparatus according to claim 5, wherein there are two pairs of said rollers, one of said pairs comprising larger diameter rollers, and the other of said pairs comprising smaller diameter rollers.

7. Apparatus according to claim 1, wherein said rotation member comprises a plurality of fixedly joined arms projecting radially from a central hub; said rollers being disposed at radially outer ends of said arms.

8. Apparatus according to claim 7, wherein first and second ones of said arms form a 90 degree angle therebetween, and each of said first and second arms forms a 135 degree angle with a third arm, said third arm being shorter than said first and second arms.

9. In a microwave oven comprising a cooking chamber having a floor; microwave generating means for supplying microwaves to said cooking chamber; and a tray disposed within said cooking chamber for carrying food to be cooked; the improvement comprising:

a rotation member mounted at its center in said cooking chamber for rotation about an upright axis, said rotation member including a plurality of circumferentially spaced floor-engaging portions spaced radially outwardly from said axis;

said tray being seated upon said rotation member and extending across said axis; and drive means for rotating said rotation member and said tray about said axis;

said floor including guiding means having guide portions which are spaced apart circumferentially with reference to said axis and which are disposed at mutually different elevations, said floor-engaging portions engaging said guide portions as said rotation member rotates for causing said rotation member and said tray to be raised and lowered during rotation;

a radial spacing of a first of said floor engaging portions from said axis being less than that of a second of said floor-engaging portions;

a radial spacing of a first of said guide portions from said axis being less than that of a second of said guide portions;

said first and second floor-engaging portions being engageable with said first and second guide portions, respectively, during rotation of said rotation member.

10. Apparatus according to claim 9, wherein some of said guide portions are flat and others of said guide portions project upwardly in generally convex fashion.

* * * * *